United States Patent [19]

Keller et al.

[11] 4,043,464

[45] Aug. 23, 1977

[54] ANTI-CHOKE APPARATUS

[75] Inventors: Alex J. Keller, Gastonia; Joseph R. Williams, Kings Mountain; James K. Mosteller, Mount Holly, all of N.C.

[73] Assignee: Automatic Material Handling, Inc., Bessemer City, N.C.

[21] Appl. No.: 716,275

[22] Filed: Aug. 20, 1976

[51] Int. Cl.[2] ..... D01G 13/00

[52] U.S. Cl. ..... 214/17 CA; 19/145.5

[58] Field of Search ..... 214/16 R, 17 CA, 89; 19/81, 145.5

[56] References Cited

U.S. PATENT DOCUMENTS

| | | | |
|---|---|---|---|
| 3,577,599 | 5/1971 | Goldammer | 19/145.5 |
| 3,986,623 | 10/1976 | Keller | 214/16 R |

*Primary Examiner*—Robert G. Sheridan

[57] ABSTRACT

Equipment including a pick-up head arranged on an elevated trackway for automatically picking up increments of fiber from a plurality from fiber bales, and serially delivering such fiber increments to a feeder unit which feeds the fiber to a hopper. The hopper may become choked when an excess quantity of fiber is fed thereto, and a control system is provided which automatically energizes and de-energize the feeder unit after a predetermined number of fiber increments have been delivered to the feeder unit, the total quantity of fiber in such predetermined number of fiber increments, when added to the quantity of fiber in the hopper it signals for more fiber, being less than that which will cause the hopper to become choked. A fiber guide arrangement is also included in the hopper to prevent fibers fed thereto from taking a path of movement which could choke the hopper.

10 Claims, 5 Drawing Figures

ANTI-CHOKE APPARATUS

BACKGROUND OF THE INVENTION

Equipment is now in widespread use which is designed to automatically pluck fibers from a plurality of fiber bales and then deliver such fibers to a hopper or an apron in a fiber processing system. Equipment of this type is disclosed in U.S. Pat. No. 3,777,908 and in U.S. application Ser. No. 598,434, filed July 23, 1975, now U.S. Pat. No. 3,986,623, and such equipment has been found to have particular application in bale opener systems where different kinds of fibers are opened and mixed or blended in a predetermined ratio.

In systems of this sort, one or more hoppers are used, and each hopper has a plurality of bales located adjacent thereto in a bale laydown, with some of the bales in the laydown normally having a fiber content different from other bales in the laydown whereby a predetermined blend will be obtained when fiber is plucked from all of the bales in a laydown and delivered to the hopper. Each hopper continuously opens the fiber clumps fed thereto and delivers such opened fiber to a blending line, and each hopper normally includes an apron or conveyor extending from the intake side thereof to receive and collect the fibers plucked from the bales and then automatically convey such fibers to the hopper in response to a signal from the hopper indicating that it requires an additional quantity of fiber.

The aforementioned equipment for automatically plucking and delivering fibers to the hopper apron includes an elevated trackway on which a pick-up head is carried, and an automatic control system is provided for causing the pick-up head to move across the line of hopper aprons and monitor such aprons to determine which of them are empty and require additional fibers. If an apron is empty (e.g., it has automatically fed the fibers previously supplied thereto to the hopper), a signal is generated by a photoelectric cell in such apron that is detected by the pick-up head monitoring system, and the pick-up head is then caused to move, serially, to a position above each bale located adjacent such apron, pluck an increment of fiber therefrom, and deliver such increment to the apron, all as explained in greater detail in the aforesaid U.S. application Ser. No. 598,434. Thus, when an apron signals that it is empty, one increment of fiber is automatically plucked from each bale adjacent the apron and delivered to the apron in sequence, whereby the apron is always supplied with the desired proportions of fibers from all of the bales in the bale laydown, and this quantity of fibers accumulates on the apron until the hopper automatically causes the apron to feed such accumulated fibers to the hopper as described above.

In some situations, particularly when it is desirable to feed fibers from a large number of bales to a single hopper, a relatively large quantity of fiber may accumulate on the apron at one time because the pick-up head will automatically deliver in crements of fiber thereto from all of these bales, and all of the increments of fiber will be delivered to the apron before the hopper signals for additional fiber. Moreover, when the hopper does thereafter signal for additional fiber, the apron will deliver all of this large accumulation to the hopper at one time, and this will frequently cause the hopper to choke. More specifically, the hopper, as indicated above, generates a signal for additional fiber when the fiber therein reaches a predetermined minimum level, but this predetermined minimum level, when combined with the large accumulation of fiber fed thereto by the apron, will often result in the fiber exceeding a predetermined maximum level so as to cause the hopper to become choked.

Thus, if a hopper has a predetermined maximum fiber level of 100 pounds and a predetermined minimum level of 40 pounds, and if the pick-up head is programmed to deliver fiber to the apron from four bales in increments of 20 pounds from each bale, it will be apparent that 80 pounds of fiber could accumulate on the apron so that when this 80 pounds is fed to the hopper and combined with the 40 pounds already therein, the 120 pounds of fiber could choke the hopper.

In an effort to overcome this choking problem, an attempt was made to utilize a time delay circuit between the aforesaid photoelectric cell in the apron and the drive therefor whereby when the first increment of fiber was delivered to the apron, the photoelectric cell circuit would close to cause the apron to be driven for a predetermined length of time to deliver the first increment of the fiber to the hopper, even though it was not signaling for additional fiber, and thereby decrease the accumulation of fiber on the apron. This predetermined length of time was selected to correspond of the time normally required for the pick-up head to go to the next bale and deliver the next increment to the apron. However, it has found that the time required for the pick-up head to travel to, and pluck from, different bales varied substantially, particularly where the bales being plucked were of varying heights, and this timed method of controlling the apron delivery was therefore not fully satisfactory in the field.

In accordance with the present invention, apparatus is provided for preventing choking of the hopper by controlling the apron in response to a predetermined number of fiber increments being delivered to the apron whereby the quantity of fiber delivered to the hopper by the apron can be effectively maintained at a level which will not choke the hopper.

SUMMARY OF THE INVENTION

The present invention provides an anti-choke control system for the hopper apron, or conveyor, which automatically energizes the apron drive after a predetermined number of increments of fiber have been delivered to such apron, and which automatically de-energizes such apron drive before any further fiber increments are delivered to the apron. This predetermined number of increments of fiber is selected to assure that the total quantity of fibers included therein is less than the difference between the aforesaid predetermined maximum and minimum fiber quantity levels of the hopper.

In the disclosed embodiment of the present invention, the pick-up head generates a signal each time it delivers an increment of fiber to the apron, and the anti-choke control system is responsive to receiving a predetermined number of such pick-up head signals and then energizes the apron drive whereby the increments of fiber corresponding to such predetermined number of pick-up head signals will be fed to the hopper by the apron. Moreover, the anti-choke control system is thereafter responsive to the next pick-up head signal to de-energize the apron drive whereby the additional number of increments of fiber delivered to the apron will not be fed to the hopper with the first increments of fiber, and this additional number of increments includes a total quantity of fiber which is less than the aforesaid difference between the predetermined maximum and minimum fiber quantity levels of the hopper. Thus, while the total quantity of fiber included in the entire series of fiber increments delivered to the apron may exceed the difference between the predetermined maximum and minimum fiber quantity levels of the hopper, the anti-choke control system causes this total quantity of fiber to be fed to the hopper in divided portions, none of which exceed the difference between the predetermined maximum fiber quantity levels of the hopper.

Additionally, some hoppers include an inclined conveyor and an extending rake member which is arranged to pivot through a predetermined arc and which is biased to urge the fibers in the hopper against the inclined conveyor to promote proper opening and transporting of the fibers by the inclined conveyor, and the present invention provides a guide for the fibers being fed into the hopper, such guide located adjacent the extending end of the rake member and cooperating therewith to direct fibers to a location between the rake member and the inclined conveyor whereby such fibers cannot become located at the opposite side of the rake member and thereby cause choking of the hopper as a result of improper operation of the rake member.

DESCRIPTION OF THE PREFERRED EMBODIMENT

Figure 1:
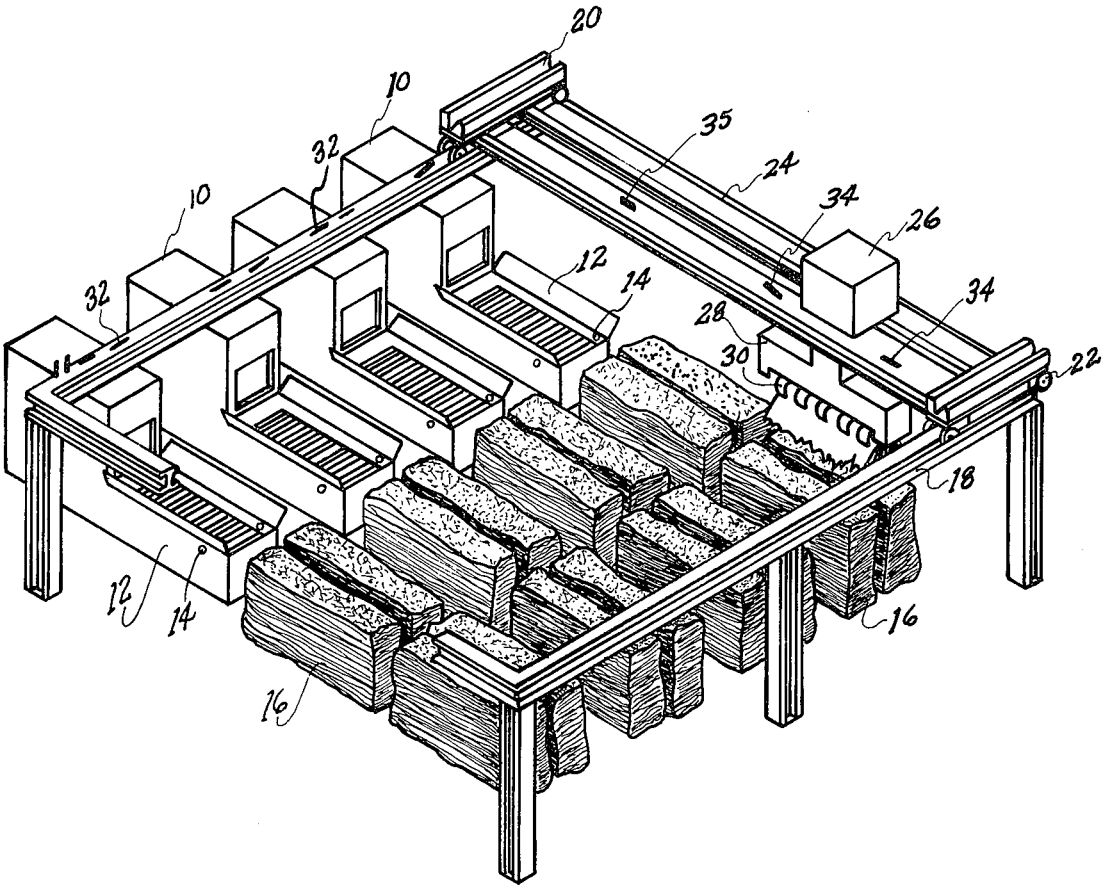
FIG. 1 is a perspective view illustrating the general arrangement of a plurality of hoppers, each having an extended apron, and the equipment for automatically plucking fibers from a plurality of bales and delivering such fibers to the hopper aprons.

Looking now in greater detail at the accompanying drawings, FIG. 1 illustrates a plurality of fiber feeding machines or hoppers 10 each provided with an extended apron or conveyor 12 that constitutes a feeder unit for its associated hopper and that includes a conventional photoelectric cell 14 arranged to generate an electric signal when the quantity of fiber on the apron 12 is exhausted or reaches a predetermined low lever. A plurality of bales 16 are situated in selected bale positions forming a bale laydown consisting of two parallel rows of bales 16 extending from each apron 12.

An elevated trackway 18 is provided which extends over the line of aprons 12 and the rows of bales 16, and a crane 20 having wheels 22 is mounted on the trackway 18 for movement therealong. The crane 20 includes a pair of parallel tracks 24 extending generally parallel to the rows of bales 16, and a dolly 26 is carried on the tracks 24 by wheels (not shown) for movement therealong. The dolly 26 supports a pick-up head 28 arranged for vertical movement with respect to the dolly 26, and the pick-up head 28 includes a plurality of tongs or finger elements 30 that open and close selectively to pluck an increment of fiber from the top surfaces of the bales 16 when the pick-up head is lowered to a predetermined position with respect thereto.

To control the operation of the pick-up head 28, trackway 18 is provided with a plurality of cams 32 positioned thereon to correspond with each row of bales 16, and one of the tracks 24 is likewise provided with a plurality of cams 34, one positioned above each bale position in a row of bales. The details of the control system for the pick-up head 28 do not form part of the present invention, and reference is made to the aforesaid U.S. application Ser. No. 598,434 for a more complete description of said control system. For the purpose of understanding the present invention, it is sufficient to note that the pick-up head control system constantly monitors the photoelectric cells 14 of the aprons 12, and when one of such photoelectric cells 14 generates a signal indicating that an apron 12 is empty or requires additional fiber, the tracks 24 move to a position directly above the signaling apron 12, as determined by one of the cams 32. The dolly 26 is then caused to move to a position over one of the bales 16 behind the signaling apron 12, as determined by the cams 34, whereupon the pick-up head 28 is lowered to pluck an increment of fiber from such bale 16 and raised, and the dolly 26 is then moved to a position above the signaling apron 12 where a drop cam 35, which is not shown in the aforesaid U.S. application Ser. No. 598,434, trips a switch on the dolly 26 to cause the dolly to stop and to cause the pick-up head 28 to release the increment of fiber held thereby so that such increment of fiber drops onto the signaling apron 12. This operation is repeated, in sequence, until all, or at least a preselected group, of said bales 16 behind the signaling apron 12 have had one increment of fiber plucked therefrom and delivered to the signaling apron 12.

Each apron 12 includes a conveyor 36 (see FIG. 2) having a horizontal reach 38 onto which the increments of fiber are dropped, and this conveyor 36 is driven by a motor 40 to cause the horizontal reach 38 to move toward the hopper 10 and deliver the increments of fiber to a conveyor 42 in the hopper having a horizontal reach 44 which, in turn, delivers the fiber to an inclined conveyor 46 in the hopper 10. The hopper 10 also includes a conventional pivoted rake member 48 consisting of a plurality of extending elements 50 (FIG. 3) mounted on a pivot rod 52 and biased (not shown) in a direction toward the inclined conveyor 46 so that the rake member 48 pivots through a predetermined arc with the bias imposes thereon acting to hold the fibers in the hopper 10 against the inclined conveyor 46 whereby such fiber will be carried upwardly by the inclined conveyor to deposit the same on a feed table (not shown) or similar device located at the discharge end of the hopper 10, the inclined conveyor 46 also acting to assist in opening any clumps of fiber which are present in the hopper 10.

Thus, the fibers in the hopper 10 are continuously carried in a somewhat circular pattern between the rake member 48 and the inclined conveyor 46, and a portion of these fibers is continuously delivered from the hopper 10 by the inclined conveyor 46. The hopper 10 includes a photoelectric cell 54 mounted in one wall thereof at a predetermined height for monitoring the level of the fibers located between the rake member 48 and the inclined conveyor 46, and when the quantity of such fiber reaches a predetermined minimum level, the photoelectric cell 54 generates a signal which causes the apron motor 40 to become energized whereby fiber on the conveyor 36 is fed to the hopper 10.

Heretofore, the conveyor 36, once energized, operated continuously until all of the fiber increments deposited thereon in a preselected series by the pick-up head 28 were conveyed to the hopper 10, and this would, in some instances, cause the hopper 10 to choke as a result of the quantity fiber in the hopper 12 exceeding its previously mentioned predetermined maximum level. For example, in a typical operation of the equipment illustrated in FIG. 1, the automatic control system for the pick-up head 28, upon receiving a signal from the photoelectric cell 14 of a particular apron 12, automatically causes the pick-up head 28 to pick up sequentially an increment of approximately 20 pounds of fiber from each of the four bales 16 behind the signaling apron 12 and to deliver all of such fiber increments to the conveyor 36 of the apron 12, whereby it is possible for 80 pounds of fiber to be located on the conveyor 36 at one time. Moreover, the photoelectric cell 54 is arranged to produce a signal when the quantity of fiber therein reaches a predetermined minimum level of approximately 40 pounds, and the hopper 12 can become choked when the quantity of fiber therein reaches a predetermined maximum level of 100 pounds. It will be apparent, then, that since the difference between the predetermined minimum and maximum quantity levels in the hopper 10 is 60 pounds, and since the total quantity of fiber delivered to the apron 12 in a series of fiber increments is 80 pounds, it is quite possible that the hopper 10 may become choked if the entire 80 pounds of fiber in the apron 12 is delivered to the hopper 10 at one time in response to a signal from the hopper photoelectric cell 54. It is to be noted that the foregoing illustration is merely typical and other quantity levels may be encountered in different equipment set ups, and the present invention will have application in any equipment where the total quantity of fiber fed to an apron in a preselected series of increments exceeds the difference between the predetermined maximum and minimum quantity levels of the hopper 10.

In accordance with the present invention, a control system is provided for causing the apron conveyor 36 to be automatically energized after a predetermined number of fiber increments have been deposited thereon, with such predetermined number of fiber increments being selected to assure that the total quantity of fiber in said predetermined number of fiber increments is less than the difference between the predetermined maximum and minimum quantity levels of the hopper 10.

More specifically in the preferred embodiment of the present invention, the control system for the apron conveyor 36 is designed to energize the apron motor 40 after a predetermined number of fiber increments have been dropped onto the conveyor 36 by the pick-up head 28. As previously described, the pick-up head 28, after picking up an increment of fiber from a bale 16 behind an apron 12, will carry such increment of fiber to a position above the apron 12 where it engages the drop cam 35 that causes the fingers 30 to release the increment of fiber which then drops onto the conveyor 36 of the apron 12. In addition to this control function for the drop cam 35, the drop cam 35, in accordance with the present invention, also generates a signal each time an increment of fiber is dropped onto the conveyor 36 and these signals are utilized to control the operation of the motor 40 for the conveyor 36. Depending on the quantity of fiber in each increment, and the difference between the aforesaid maximum and minimum quantity levels of the hopper 10, the apron motor 40 is automatically energized in response to a predetermined number of signals from the drop cam 35, and then automatically de-energized by the next signal received from the drop cam 35 so that no further fiber increments from a series of fiber increments is delivered to the hopper 10 by the apron conveyor 36.

Thus, returning to the typical operation described above where four fiber increments of 20 pounds each are sequentially picked up and delivered to the apron 12 in a series by the pick-up head 28, the conveyor motor 40 may be automatically energized in response to the second signal generated by the drop cam 35 and then de-energized in response to the third signal generated by the drop cam 35. Therefore, only 40 pounds of fiber will be fed to the hopper 10, and this 40 pounds is less than the 60 pounds which would choke the hopper 10. Moreover, the last two fiber increments will subsequently be delivered to the apron 12 by the pick-up head 28 in response to the apron motor 40 receiving a signal from the hopper photoelectric cell 54, but since these two increments also include a total of only 40 pounds, the hopper 10 will not become choked when these two increments are ultimately fed to the hopper 10 in response to the signal generated by the hopper photoelectric cell 54 when the quantity of fiber therein reaches the aforesaid predetermined minimum quantity level. Thus, while the pick-up head 28 always picks up an increment of fiber from each of the four bales behind the apron 12 so as to maintain the proper blend of fiber ultimately fed to the hopper 10, the total quantity of fiber fed to the hopper 10 at any one time by the apron conveyor 36 is always less than the quantity of fiber which will choke the hopper 10. Also, while the foregoing typical illustration includes four fiber increments which are fed to the hopper in groups of two such increments, the control for the apron motor 40 may be made responsive to any number of pick-up head drops, depending on the particular quantity of fiber included in each fiber increment and on the quantity of fiber which will choke the hopper. The significant point is that the total quantity of fiber represented by all of the fiber increments is fed to the hopper 10 in divided parts, each of which is less than the quantity of fiber which would choke the hopper 10.

Also, since the moving pick-up head 28 supplies fiber to a plurality of aprons 12, the apparatus of the present invention also includes an anti-choke switch 56 located on the trackway 18 above each apron 12 (see FIG. 3), and the moving crane 20 is formed with a cam 58 which engages and closes the appropriate switch 56 when the crane 20 stops above the corresponding apron 12 to which fiber will be delivered by the pick-up head 28. As will be explained in greater detail presently, the anti-choke switches 56 are placed in the control circuit for the apron motors 40, respectively, to assure that the initial fiber increment feeding for a designated apron 12 will only be carried out when the crane 20 and pick-up head 28 are located above such designed apron 12.

Figure 5:
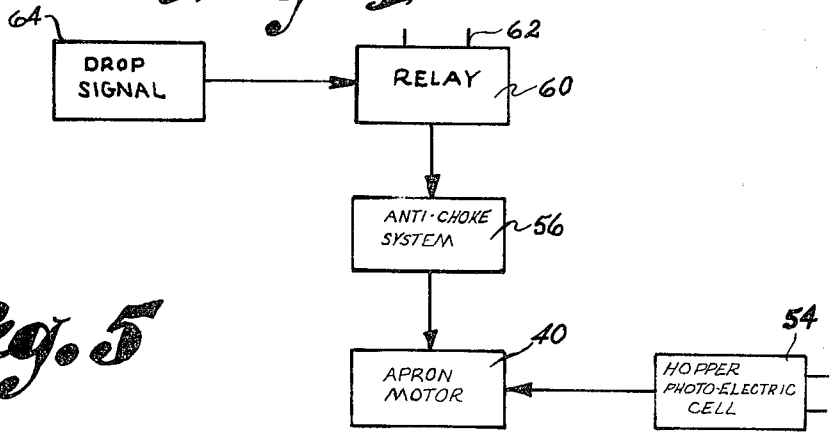
FIG. 5 is a diagrammatic illustration of the anti-choke control circuitry.

The specific electronic details of the control system described above form no part of the present invention, and it will be appreciated that a variety of circuits could be utilized to carry out the unique operational characteristics of the present invention. FIG. 5 illustrates, in diagrammatic form, a typical arrangement for controlling an apron motor 40 in the manner described above. This typical arrangement includes a relay 60 which is connected to a conventional electrical supply line 62, and the aforementioned signal, generated by the pick-up head 28 each time an increment of fiber is dropped onto the apron conveyor 36, is represented by the block 64. Thus, looking at FIG. 5, when the pick-up head 28 has dropped the aforementioned predetermined number of fiber increments, a signal is sent to the relay 60, causing it to close, whereby a circuit is completed from the electrical supply line 62 to the anti-choke switch 56. Since the anti-choke switch 56 is closed, as described above, by the crane 20 being over the designated apron 12, a circuit is completed from the electrical supply line 62 to the apron motor 40 whereby it is energized to operate the apron conveyor 36 to feed the predetermined number of increments to its associated hopper 10. When the pick-up head 28 drops the next fiber increment, a further drop signal is sent to the relay 60, causing it to open, and the apron motor 40 is immediately stopped to prevent the further feeding of the remaining fiber increments to the hopper 10. However, when the level of fiber is the hopper 10 thereafter reaches the aforesaid predetermined minimum level, the photoelectric cell 54 therefor will act to close a circuit to the apron motor 40 to energize the same and cause the remaining increments of fiber on the apron conveyor 36 to be fed into the hopper 10. Thus, for the first predetermined number of fiber increments dropped, the apron conveyor 36 will automatically be caused to feed such increments to the hopper 10 and then stop. Thereafter, the remaining fiber increments dropped will be fed to the hopper 10 in response to a signal from the hopper photoelectric cell 54. After these remaining fiber increments are fed to the hopper 10, the apron photoelectric cell 14 will signal for more fiber from the pick-up head 28. As a practical matter, the time required for the pick-up head 28 to monitor and/or supply all of the other aprons 12 with fiber is sufficient to assure that by the time the pick-up head 28 returns again to the same apron 12, the hopper 10 associated with such apron 12 will have processed a sufficient quantity of fiber so that this hopper 10 can accept the predetermined number of fiber increments delivered automatically thereto by the apron 12 without choking the hopper 10.

Figure 2:
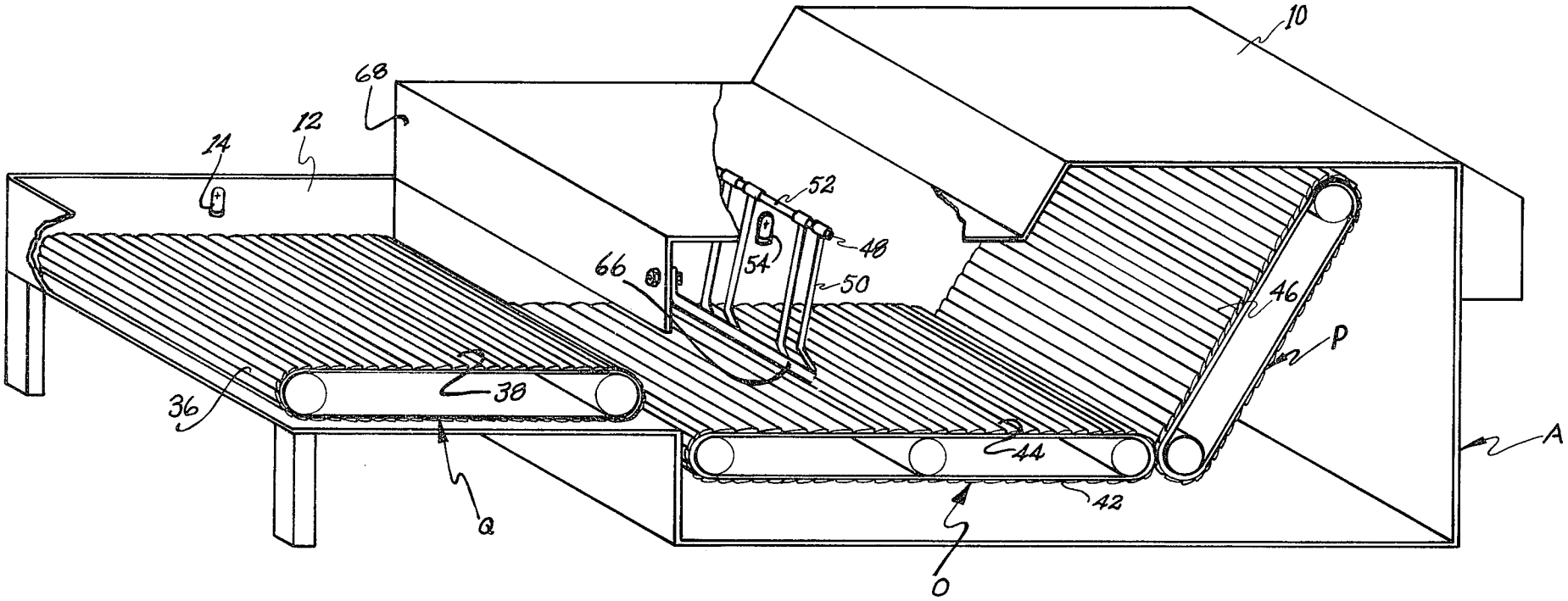
FIG. 2 is an elevation view of a hopper and an extended apron therefor.
Figure 3:
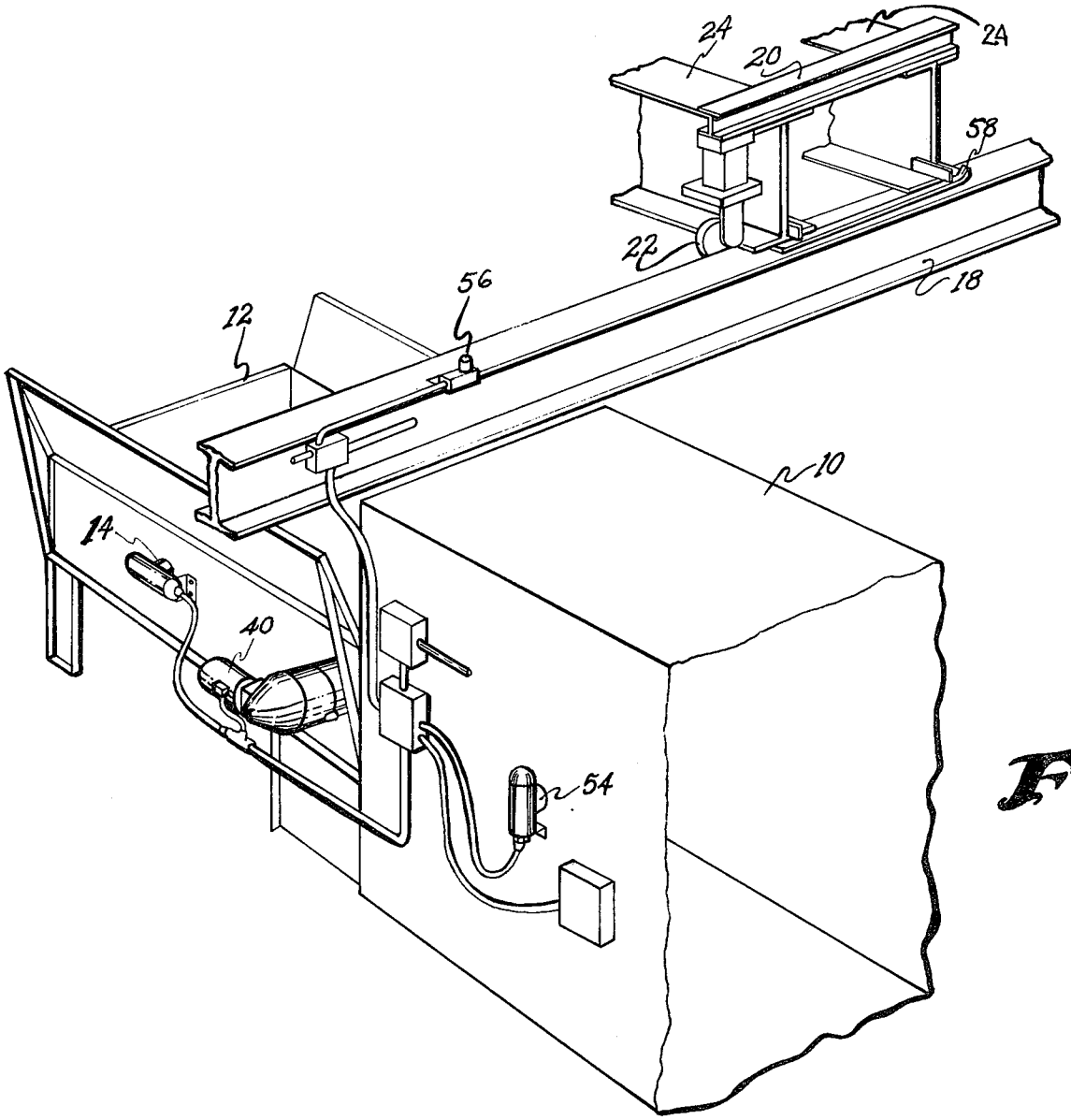
FIG. 3 is a perspective view illustrating the general relationship of a hopper, an extended apron therefor, and the overhead crane for the pick-up head.
Figure 4:
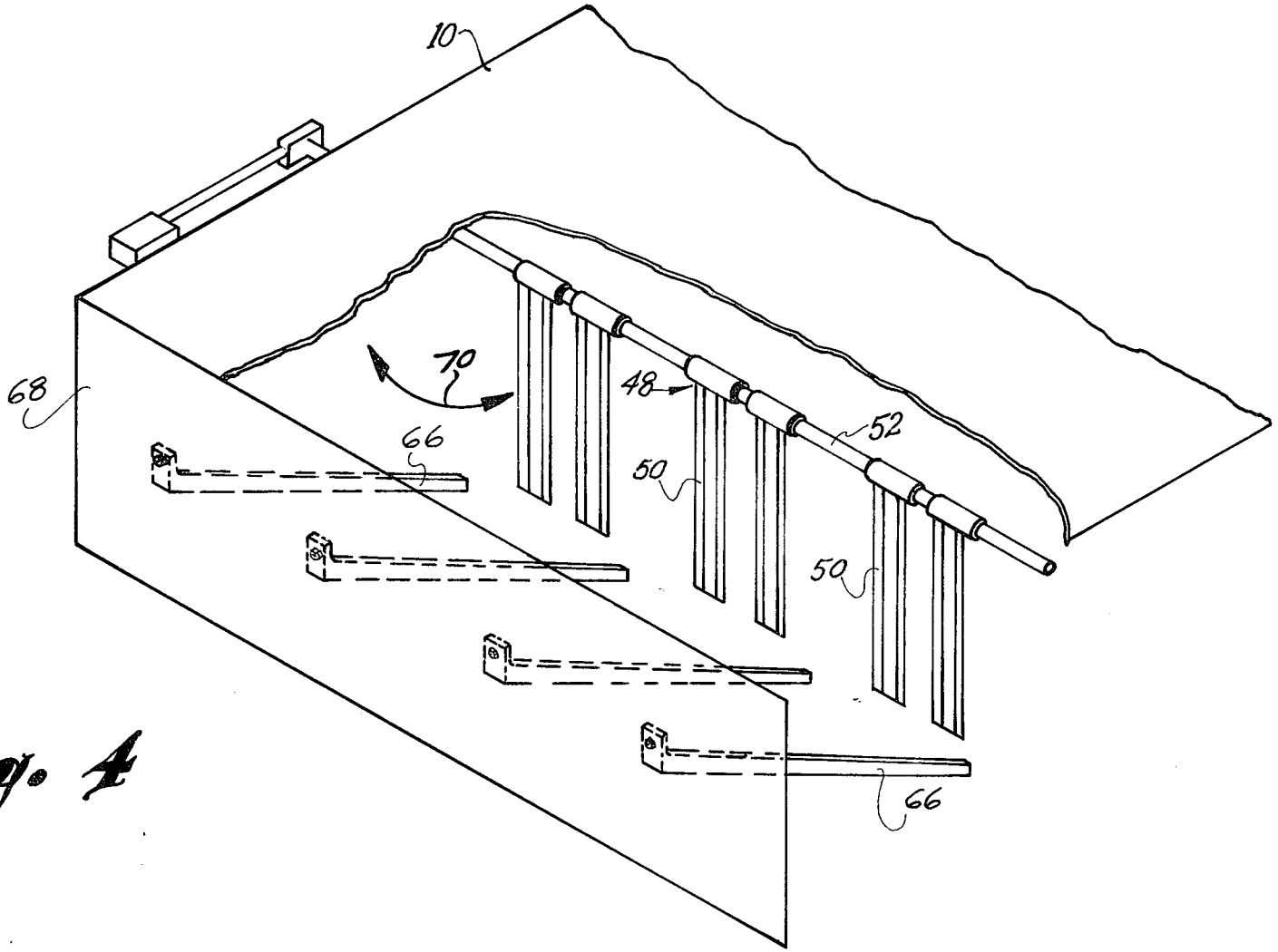
FIG. 4 is a detail view illustrating the relationship of the pivoted rake member and the fiber guide arrangement in a hopper.

In accordance with a further feature of the present invention, the hopper 10 is provided with stationary guide bars 66 (FIGS. 2 and 3) that are secured to the end wall 68 of the hopper 10 adjacent the apron 12 so as to extend therefrom at a downward inclination to a point between and adjacent the extending ends of the rake member elements 50. The rake member 48 is designed, as described above, to pivot within a predetermined arc represented by the arrow 70 in FIG. 3 and is biased in a direction toward the inclined conveyor 46 to hold the fibers in the hopper 10 thereagainst. In FIGS. 2 and 3, the rake member 48 is shown at the limit of the arc of movement closest to the inclined conveyor 46, and as more fiber is fed to the hopper 10, the rake member 48 is pivoted to the left by the accumulation of fiber in the hopper 10. In hoppers having conventional rake members 48, the fibers being fed to the horizontal hopper conveyor 42 from the apron conveyor 36 would sometimes inadvertently be carried to a location between the rake member 48 and the hopper end wall 68 rather than between the rake member 48 and the inclined conveyor 46, and such fiber, as it accumulated behind the rake member 48, would exert an additional force on the rake member 48 in a direction toward the inclined conveyor 46 which, in many cases, would choke the hopper 10. However, by virtue of the fixed guide bars 66, all fibers fed to the hopper 10 from the apron conveyor 36 are guided to a location between the rake member 48 and the inclined conveyor 46 at all pivoted positions of the rake member 48 within its predetermined arc of movement whereby no fibers can move to a position between the rake member 48 and the hopper end wall 68, and, as a result, no choking will occur because of the rake member 48 being improperly forced toward the inclined conveyor 46.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

We claim:

1. Anti-choke apparatus for use with equipment for automatically and selectively delivering fibers to a feeder unit in a preselected series of increments each including a predetermined quantity of fibers, said feeder being located adjacent a hopper which generate a signal when the quantity of fiber therein reaches a predetermined minimum level and which becomes choked when the quantity of fiber therein exceeds a predetermined maximum level, with the total quantity of fiber delivered to said feeder in said series of increments being greater than the quantity difference between said predetermined maximum and minimum quality levels of said hopper; said anti-choke apparatus comprising:

a. means for operating said feeder unit to cause the fiber therein to be fed to said hopper; and b. control means for automatically energizing said feeder unit operating means after a predetermined number of said fiber increments have been delivered to said feeder unit, said predetermined number of said fiber increments being selected to assure that the total quantity of fiber delivered in said predetermined number of fiber increments is not greater than the difference between said predetermined maximum and minimum quantity levels of said hopper, and said control means acting to automatically de-energize said feeder unit operating means before any further fiber increments are delivered to said feeder unit.

2. Anti-choke apparatus as defined in claim 1 and further characterized in that said automatic fiber delivering equipment includes an overhead pick-up means arranged to pluck said increments of fiber serially from a plurality of fiber bales located adjacent said feeder unit and to drop said increments of fiber into said feeder unit, and in that said anti-choke control means energizes said feeder unit operating means after said pick-up head has dropped a predetermined number of fiber increments into said feeder unit.

3. Anti-choke apparatus as defined in claim 1 and further characterized in that said feeder unit includes an endless conveyor having a horizontal reach onto which said increment of fiber are delivered, and in that said feeder unit operating means includes a motor energized by said anti-choke control means to move said conveyor in a direction toward said hopper to deliver said predetermined number of fiber increments thereto.

4. In combination with apparatus including an overhead pick-up means arranged on an elevated trackway to serially pluck increments of fiber from a selected group of fiber bales and deliver such increments of fiber to a position above a feeder unit and drop said increments of fiber therein, said feeder unit being located adjacent a hopper and including selectively operable means for feeding said increments of fiber dropped therein to said hopper in response to a signal from said hopper indicating that the quantity of fiber therein has reached a predetermined minimum level, said hopper becoming choked when the quantity of fiber therein exceeds a predetermined maximum level, the improvement comprising:

a. means for generating a signal each time said pick-up means drops one of said increments of fiber into said feeder unit; and b. control means responsive to receiving a predetermined number of said pick-up means signals to energize said selectively operable feeder unit means and cause the increments of fiber in said feeder unit to be delivered to said hopper, said predetermined number of said pick-up means signals being selected in relation to quantity of fiber in each said increment to assure that the total quantity of fiber in said feeder unit when it is energized is not greater than the difference between said predetermined maximum and minimum quantity levels of said hopper, and said control means being further responsive to the next signal generated by said pick-up means to de-energize said selectively operable feeder unit means.

5. The combination defined in claim 4 and being further characterized in that the quantity of fiber delivered in said increments to said feeder unit after said control means de-energizes said selectively operable feeder unit means is not greater than said difference between said predetermined maximum and minimum quantity levels of said hopper.

6. The combination defined in claim 4 and further characterized in that said feeder unit generates a signal when it is empty of fiber, and in that said overhead pick-up means serially delivers all of said increments of fiber to said feeder unit in response to said feeder unit signal.

7. The combination defined in claim 6 and further characterized in that said hopper and said feeder unit each includes a photoelectric cell for generating said hopper signal and said feeder unit signal, respectively.

8. The combination defined in claim 4 and further characterized in that said hopper includes an inclined conveyor means for transporting fiber from said hopper, an extending rake member arranged to pivot through a predetermined arc and biased in a direction to urge said fibers in said hopper against said inclined conveyor means, and stationary guide means arranged adjacent the extending end of said rake member and cooperating therewith to guide all fiber fed to said hopper from said feeder unit to a location between said rake member and said inclined conveyor means at all positions of said pivoted rake member within said predetermined arc.

9. The combination defined in claim 8 and further characterized in that said hopper includes a photoelectric cell disposed at a predetermined height and between said rake member and said inclined conveyor means, said photoelectric cell generating said hopper signal when the level of fiber in said hopper falls below said predetermined height.

10. Anti-choke apparatus for causing fibers delivered to a feeder unit to be fed to an associated hopper in divided portions, said apparatus including:

a. means for delivering fibers to said feeder unit in a preselected series of increments, each said increment including a predetermined quantity of fiber;

b. means for generating a signal each time one of said increments of fiber is delivered to said feeder unit; and c. control means:

1. operating said feeder unit to feed the fibers therein to said hopper in response to the receipt of a predetermined number of said signals, said predetermined number of signals being less than the total number of signals generated during the delivery of said entire series of fiber increments;

2. stopping the operation of said feeder unit in response to the receipt of the next signal generated after said predetermined number of signals; and 3. again operating said feeder unit to feed the fibers therein to said hopper when the quantity of fiber in said hopper reaches a predetermined minimum level.

* * * * *